United States Patent [19]

Kümmerl

[11] Patent Number: 4,888,608

[45] Date of Patent: Dec. 19, 1989

[54] PHOTOGRAPHIC DEVELOPING MACHINE

[75] Inventor: Klaus Kümmerl, Nuremburg, Fed. Rep. of Germany

[73] Assignee: Ing. Hermann Kümmerl, Laborgerätebau, Inh. Ing. Klaus Kümmerl, Nuremburg, Fed. Rep. of Germany

[21] Appl. No.: 307,256

[22] Filed: Feb. 7, 1989

[30] Foreign Application Priority Data

Feb. 12, 1988 [DE] Fed. Rep. of Germany ..... 3804292
Oct. 1, 1988 [EP] European Pat. Off. ..... 88116299.4

[51] Int. Cl.[4] ..... G03D 3/02; G03D 3/08

[52] U.S. Cl. ..... 354/299; 354/322; 354/324

[58] Field of Search ..... 354/299, 320, 321, 322, 354/324; 34/155

[56] References Cited

U.S. PATENT DOCUMENTS 4,104,668 8/1978 Laar ..... 354/299
4,252,429 2/1981 Hope et al. ..... 354/322
4,669,847 6/1987 Taniguchi et al. ..... 354/324
4,673,273 6/1987 Yoshimi ..... 354/321
4,755,843 7/1988 Foley ..... 354/324
4,806,962 2/1989 Uchida et al. ..... 354/324

*Primary Examiner*—A. A. Mathews
*Attorney, Agent, or Firm*—Spencer & Frank

[57] ABSTRACT

A machine for developing photographic material such as photographic paper includes a row of tanks for photographic processing fluids, each tank having an exchangeable rack equipped with planar guide elements and transporting rollers for moving the photographic paper through the fluid. Preceding the first tank in the row is an inlet section having feed rollers which are rotated by a free-wheeling drive unit, so that sheets of photographic paper can be inserted between the feed rollers at a fast speed and can then be advanced to the first tank at a slower speed. Following the last tank in the row is a pivotably mounted drying box which can be folded upwardly. Each tank has its own circulating system for the processing fluid therein. Each circulating system includes and exchangeable filter, a conduit system having branches, and a heating member such as a heat exchanger in one of the branches. A covering frame having inwardly oriented drip faces is disposed above the row of tanks.

17 Claims, 7 Drawing Sheets

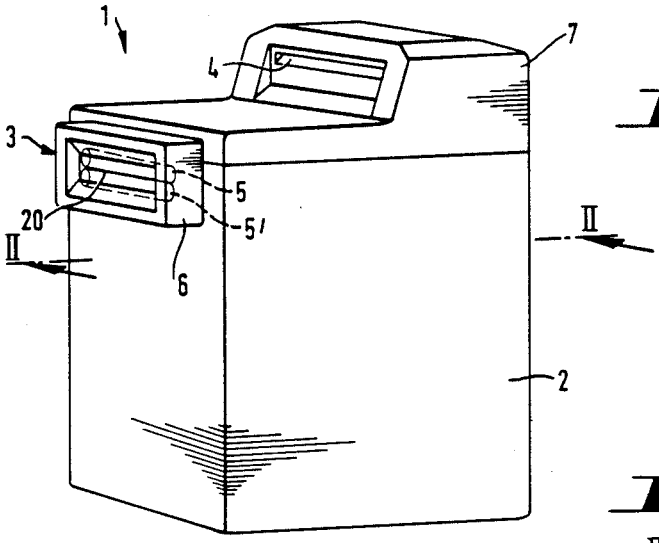
Fig. 1
Fig. 2
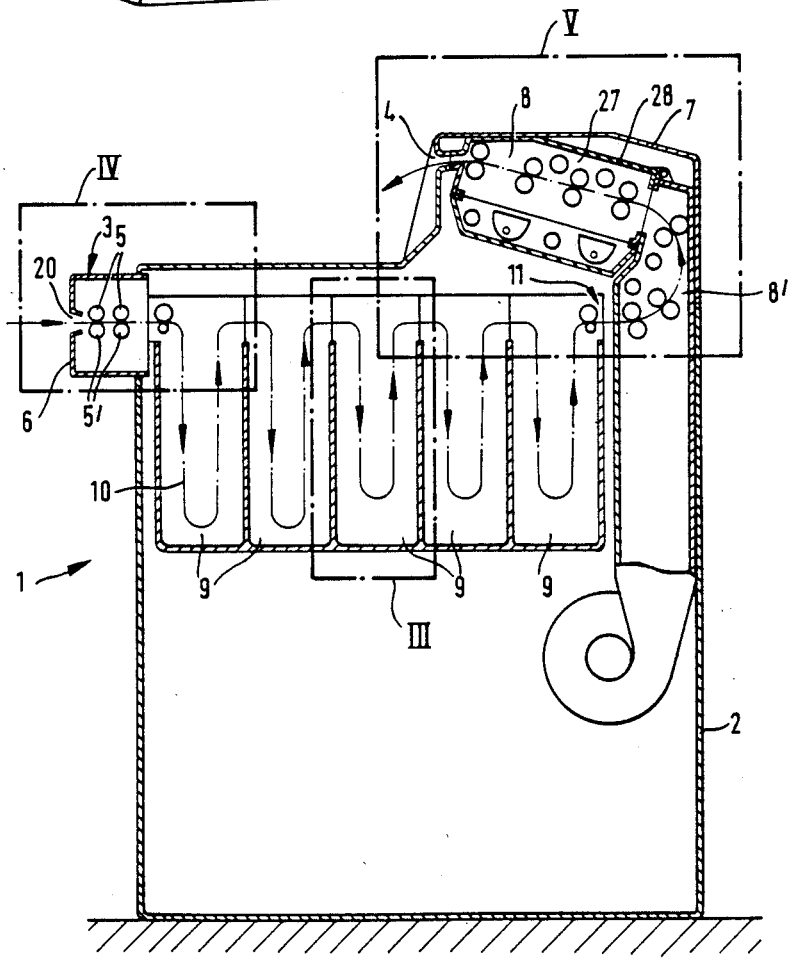

43
64
66
67
65
90
63
53
62
59
52
73
68
52
14
15
73
61
60
14
15
70
71
57
73
58
50
14
72
69
56
9
75
45
44
54
74
51
44
55

PHOTOGRAPHIC DEVELOPING MACHINE

CROSS REFERENCE TO RELATED APPLICATIONS

This application claims the priority of application Ser. No. P 38 04 292.4, filed on Feb. 12th, 1988 in the Federal Republic of Germany, and application Ser. No. 88,116,299.4, filed on Oct. 1st, 1988 at the European Patent Office, the subject matter of these applications being incorporated herein by reference.

BACKGROUND OF THE INVENTION

The present invention relates to a photographic developing machine intended, in particular, for the development of material of a certain format and includes a plurality of tanks arranged one behind the other in the direction of passage for receiving the photographic processing fluids. Each tank includes an exchangeable rack composed of planar guide element and transporting rollers for the material to be developed.

Machines of this type are known in principle. They are used preferably in professional work and can be employed, in addition to developing material of a certain format (for example, single sheets of photographic paper which are to be processed to provide 8×10 enlargements or enlargements of some other desired size), for developing roll-film, and for developing special papers, slides, and the like. Since color developing in particular is usually performed at an elevated temperature, the machines also include a thermostatically controlled heating device and a drying device following the baths for the developed pictures Consequently, these machines are able to eject completely processed, finished pictures.

Due to constant improvements in the developing process, particularly an increase in processing speed, it is necessary to modify the prior art machines. It is often not sufficient to simply increase their transporting speed and thus adapt the machines to faster processes, since such a measure, particularly in the development of paper of a certain size, would lead to malfunctions.

SUMMARY OF THE INVENTION

It is an object of the present invention to further improve the prior art photographic developing machines and to adapt them, in particular, to presently available, faster developing processes. The dimensions of the machine should not be enlarged substantially and their structure should be compact.

To solve this problem, a photographic developing machine in accordance with the present invention includes the following features:

a drying path disposed above the tanks so as to be folded up;

at least one pair of feed rollers equipped with a free-wheeling drive;

fluid circuits including heating elements and a branch stream as well as exchangeable flat filters; and a covering frame having an inwardly oriented roof slope.

This basic structure of the developing machine permits a noticeable increase in compactness which is a result, in particular, of the arrangement of the drying path. At the same time, more space is made available for the arrangement of the bath tanks, but care is taken that these tanks have the least possible horizontal structural length. The more compact structure results in a shorter traveling path and thus also in a shorter passage time.

The optimum result is obtained if all of the above features are provided in combination. However, partial results are also possible, of course, if one or the other element is left out of the combination.

Preferably the surfaces of guide elements employed in the developing machine are coated with a fluorinated polyethylene, such as tetrafluoro polyethylene. The guide elements themselves may be made of metal, preferably stainless steel, or of a suitable plastic. The coating ensures that the photographic sheet material slides easily over the guide elements without adhering thereto. This effect is of particular importance if the guide elements are disposed outside of the baths, i.e. at a location where the sheet material must be diverted from one tank to the next.

Transporting rollers are disposed in exchangeable racks in a plurality of superposed planes, with at least two mutually associated rollers being disposed in each plane to form transporting gaps. The significant fact is that the above-mentioned planes form an angle of 85° to 70°, and preferably 80°, with the vertical axis of the bath tank or, more precisely, with the exchangeable rack. In this way, the sheet material leaving the transporting gaps is easily deflected outwardly and thus reliably pushed against the guide elements disposed between the planes of the transporting rollers.

Guide elements having planar surfaces should preferably be disposed in such a manner that, during operation of the developing machine, the planar guide elements come in contact with only one side of the material to be developed, namely with the insensitive rear side. The prior art machines generally have pairs of guide elements which between them form a gap for passage of the sheet material, in which case there is an increased danger of the material being scratched and, to a certain extent, also the danger of the sheet material adhering to the guide elements and thus accumulating there.

The usual sequence of the baths in color paper developing machines includes the developer bath, the bleaching-fixing bath, as well as one or possibly also two final washing baths. If desired, an intermediate washing bath may be included between the color developer bath and the bleaching-fixing bath. However, usually this is not necessary. If necessary, a stabilization agent may be added to the last washing bath.

The finish processed paper material leaving the last washing bath must finally pass through a pair of wringer rollers so as to remove the adhering water and avoid dry corners. The still-damp material is then guided into the drying path, where it is dried within a few seconds with the use of heat and moving air. A significant feature of the developing machine of the present invention is that the drying path is disposed above the tanks for the bath fluids. In order to make the tanks freely accessible when required, the drying path is preferably able to be folded upwardly. Thus, the entire drying apparatus can be folded about a pivot axis and can preferably be retained in the folded-up state. Folding up is possible even if paper is in the machine so that the process is accessible at an time.

To improve the guidance of air, a blower is preferably connected with a guide channel by way of a conveying chute. The guide channel includes a plurality of guide rollers arranged in an arc which guide the sheet material, when it leaves the final washing section, to the movable drying rack while reversing its position. By way of sealing elements, the drying box is connected in an air-tight manner with the guide channel. Such an arrangement ensures that the air furnished by the blower can be conducted optimally to the drying path by way of the above-mentioned conveying chute without any guide hoses being provided. If the drying box is folded up, the air exits into the atmosphere. Once the drying box is folded down again (the working position), the original air passage is reestablished automatically.

The underside of the drying box is preferably connected with a radiator box by way of a further hinge joint. This radiator box includes one or a plurality of infrared radiators and additional air nozzles to remove moisture.

Thus, blower pipes are disposed in the guide channel, in the drying box, and in the radiator box. Since it is very important for uniform drying that the streams of air generated by the blower pipes be uniformly distributed over the entire width of the papers to be dried, blower pipes which have adjustable air discharge gaps are preferably employed.

The radiator boxes are equipped with controllable infrared radiators disposed in the focal line of parabolic mirrors. The infrared radiators may be controlled by way of known electronic control circuits Another important feature of a developing machine in accordance with a preferred embodiment of the invention is the configuration of the fluid stream produced by circulating the bath fluids. For this purpose, it is known to equip each tank with its own circulating system composed of a pump and a fluid conduit. A developing machine in accordance with a preferred embodiment of the invention preferably includes a bypass in each conduit to divide the fluid stream into two branch streams, one of which is returned directly to the tank while the other is conducted through a heat exchanger and then back into the tank. This measure permits the heat exchangers to remain small and compact and it is possible, in particular, to keep bath temperatures constant in an economical manner in that heat is replenished simply by cooling.

In a preferred embodiment, the branch stream which is returned directly to the tank is preferably conducted into the tank through a nozzle member which, during operation of the machine, is disposed below the liquid level. With such a nozzle member, the returned fluid stream is conducted immediately into the vicinity of the sheet material to be developed and disposed in the fluid. On the other hand, the bath fluid is stirred intensively in this region, which is known to be important for uniform operation of the process.

A branch conduit preferably branches off from the conduit system disposed at the bleaching bath to conduct a portion of the bleaching bath to a nozzle pipe. In operation, the nozzle pipe wets a feed roller which guides the picture material into the bleaching bath. In this way, the material leaving the developer bath is brought into contact with the bleaching bath immediately after the developing process is concluded and the developing process is terminated quickly. The fastest possible termination of the developing process after discharge of the material from the developer bath is known to be of particular significance in modern rapid-development processes.

In order for the bleaching fluid on the intake roller not to contaminate the developer path, a squeegee is preferably associated with the feed roller of the bleaching bath to keep the roller free of the bleaching bath on the side oriented toward the developer tank.

It is important for the sake of user friendliness of such machines that the parts which come in contact with the bath fluids can be cleaned quickly and easily. In this connection, the conduits for the bath fluids are preferably connected to the tanks or to nozzle pipes by way of plug-in connectors. These plug-in connectors may be simple tubular couplings in which two mating tube sections are pushed into one another in the manner of a telescope, or the couplings may be of the type which are under spring pressure and which are automatically released when the coupled-in parts project. Details about this can be found in the description of the drawing figures.

As has already been pointed out, it is desirable in connection with developing machines for such machines to be of the most compact configuration possible. The structure of the required bath fluid filter elements contributes significantly to the accomplishment of this. In a preferred embodiment of the invention, an insertable flat filter is preferably provided in each tank in the vicinity of its wall, with such filter being removable toward the top. Such a flat filter is suitable to combine a large filter area with a small requirement for space. For this purpose, the flat filter may be composed of a flat, U-shaped holder whose open side is covered with filter fabric and whose rear side is provided with openings for the passage of fluid. Preferably, the holder for the flat filter should be closed at the bottom to form a pocket. Filter residues dropping from the vertically oriented filter can then collect in this pocket.

The compact structure results in the bath tanks standing in close proximity to one another. To prevent undesirable transfer of bath fluids from one tank to another during removal or re-insertion of the guide racks, the entire group of tanks is preferably surrounded, in the region of their upper edges, by a frame which has inwardly oriented drip surfaces for the bath fluids, with these drip surfaces being provided with rib-shaped raised portions in the border regions of the tanks to prevent the down-flowing fluid from entering the wrong tank.

BRIEF DESCRIPTION OF THE DRAWINGS

FIG. 1 is a perspective view of a developing machine in accordance with the present invention.

FIG. 2 is a longitudinal sectional view of the machine seen along line II—II of FIG. 1.

DESCRIPTION OF THE PREFERRED EMBODIMENT

Figure 3:
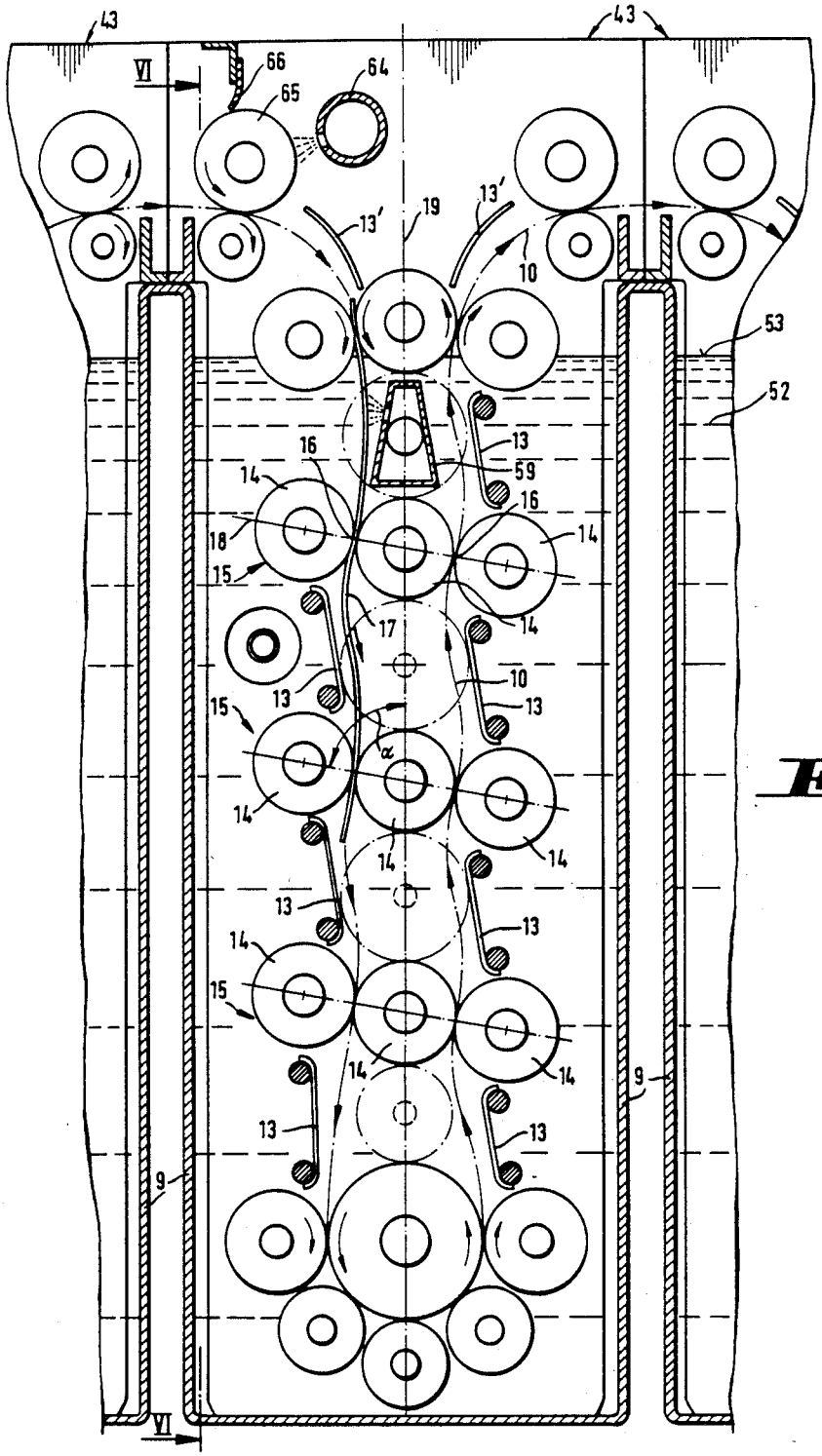
FIG. 3 is a schematic longitudinal sectional view of the arrangement of the guide elements and transporting rollers (detail III of FIG. 2).

The photographic developing machine as a whole is marked with reference number 1 in FIG. 1. It is composed of a machine housing 2, an inlet section 3 for the exposed photographic material to be developed, and a discharge gap 4 for the completely developed material. To facilitate the following discussion it will be assumed that the photographic material to be developed consists of exposed sheets of photographic paper, and that the completely developed material discharged through gap 4 consists of pictures. In inlet section 3, there are provided feed rollers 5 and 5' which serve to transport the photographic paper to be used. Feed rollers 5 and 5' are surrounded by a light-tight box 6 whose front is open. The box 6 is connected directly to the exposure machine, a so-called printer (not shown).

In FIG. 2, a drying path 8 is disposed in a hoodlike extension 7 of the machine and is connected with a wet section of the machine by way of a guide channel 8'.

FIG. 2 also shows that a plurality of tanks 9 accommodating the bath fluids are disposed in the interior of machine housing 2. With the aid of special racks equipped with guide elements and transporting rollers, which will be described later, the sheets of photographic paper to be developed are transported through these baths in the direction of dot-dash line 10. Once they leave the baths at 11, they are completely developed, bleach-fixed, and finally washed, and must merely be freed of adhering water and of the water absorbed by the coating. For this purpose, the sheets are initially conducted through a pair of wringer rollers 12 (see FIG. 5) and then, after deflection, to the drying path 8.

FIG. 3 shows the arrangement of the guide elements which guide the sheets of photographic paper through the photographic processing baths. Planar guide elements 13 and transporting rollers 14 are disposed in a rack 43 which can be exchangeably inserted into tanks 9. At least two mutually associated transporting rollers 14 which together form a transporting gap 16 are disposed in each plane. The material being developed, such as sheets 17 of photographic paper, is guided through this transporting gap, always forming an angle of 90° with a connecting line 18 passing through the axes of rotation of transporting rollers 14. This fact is utilized according to the invention to impart a slightly outwardly sloped direction to the sheets 17 being developed to thus securely guide them against guide elements 13, which are disposed between the rows 15 of the transporting rollers 14. The angle $\alpha$ formed by connecting line 18 with vertical axes 19 is about 85° to 70°, and preferably 80°. The direction of movement imparted by this arrangement to the sheets 17 being developed can be seen in FIG. 3.

Guide elements 13 are disposed between the rows 15 of transporting rollers 14. The guide elements 13 are preferably arranged in such a manner that, during operation of the machine, they come in contact with only one side of the sheets 17 being developed, namely the in-sensitive rear side. In this way, the photographic material is treated gently without any loss of reliable guidance.

Curved guide elements 13' are provided to divert the sheets 17 as they enter and exit the bath.

Figure 4:
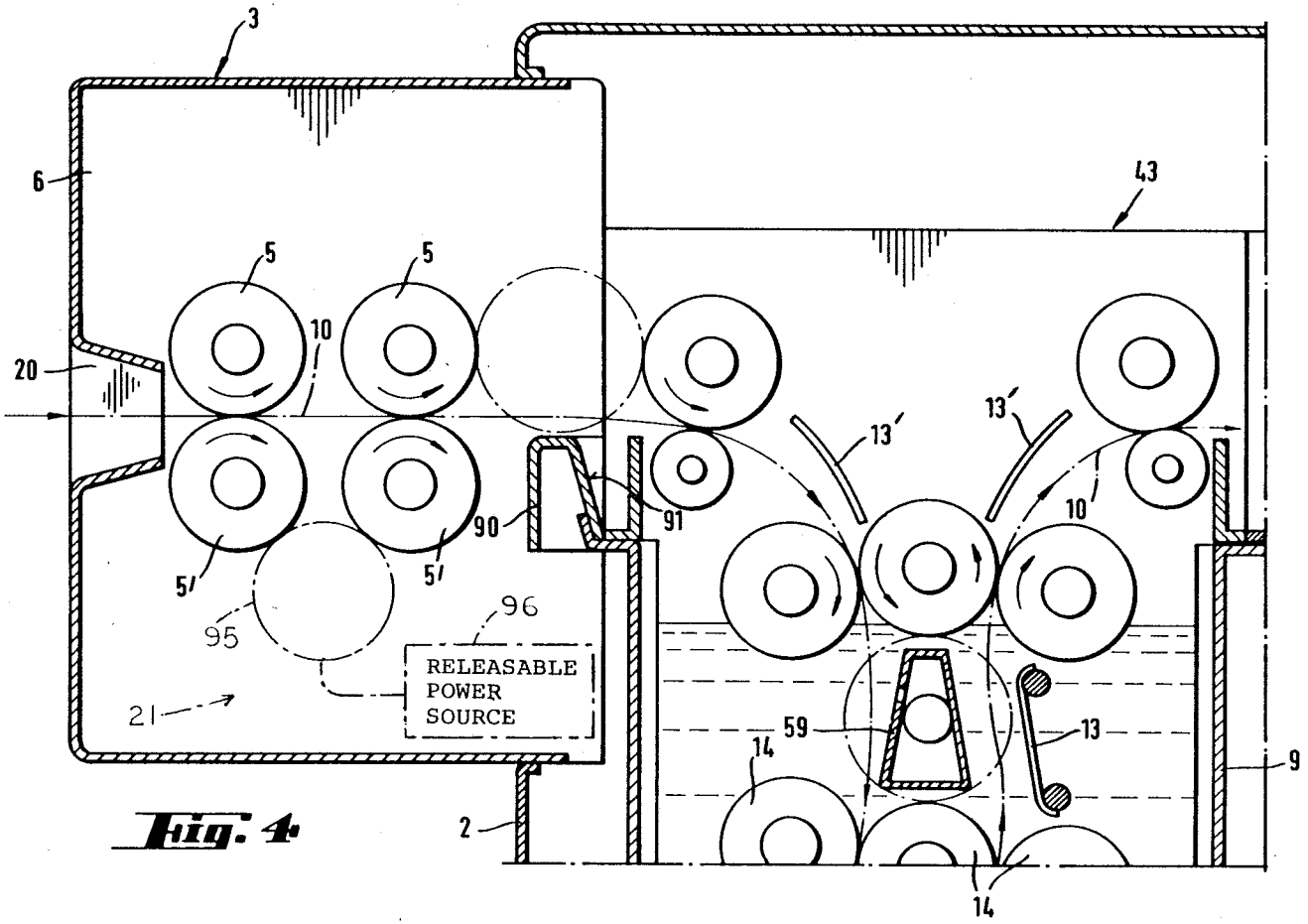
FIG. 4 is a schematic longitudinal sectional view of the paper intake section (detail IV of FIG. 2) in a developing machine.

FIG. 4 is a schematic representation of the feed section 3 of the machine. Immediately following the intake gap 20, there are the feed rollers 5 and 5' which, in the illustrated embodiment, are rotated by a free-wheeling drive unit 21. Free-wheeling drive unit 21, which is shown only schematically using dot-dash lines, may include a toothed wheel 95 which meshes with gears (not shown) affixed to feed rollers 5'. Drive unit 21 also includes a releasable power source 96 (such as a motor, speed-reduction gearing, and a slip clutch) which rotates toothed wheel 95 except when a reverse torque is exerted on toothed wheel 21. Free-wheeling drive unit 21 serves the following purpose: usually, the exposed sheets 17 of photographic paper are discharged from the exposure machine (not shown) at a relatively high speed (e.g. 10 cm/sec) and are pushed into intake gap 20 of the developing machine 1. However, the regular intake speed of the developing machine 1 is much less (e.g. 3 cm/sec). This difference is compensated by the free-wheeling drive of feed rollers 5 and 5' in that the rapidly injected photographic paper carries these rollers along and causes them to rotate. In this way, the paper is received in the space occupied by the rollers. As soon as the exposure machine ceases to push, the free-wheeling drive unit 21 again takes along feed rollers 5' and pulls the paper into the automatic developing machine 1 at a reduced speed.

Figure 5:
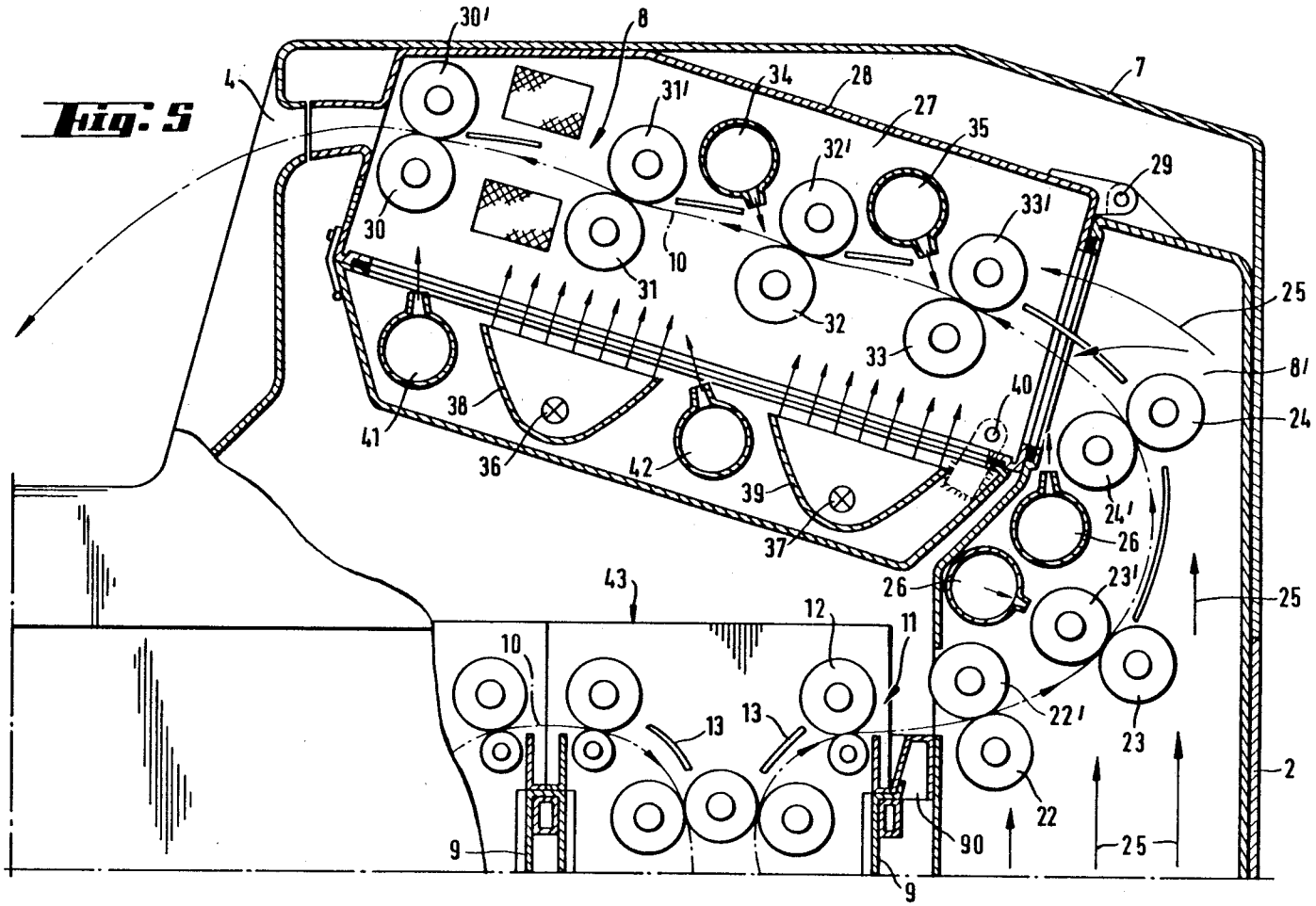
FIG. 5 is a schematic longitudinal sectional view of the drying section of a developing machine (detail V of FIG. 2).

FIG. 5 shows essential elements of the drying section of the machine 1. The finish developed sheets 17 or pictures leave the developing section of the machine when they pas through the pair of wringer rollers 12. Between these rollers, any water adhering to the surface is stripped off. The sheets 17 are then guided along line 10 through guide rollers 22 and 22', 23 and 23', and 24 and 24', are reversed, and are then guided into the final drying section. However, the sheets ar already preliminarily dried in the region of the guide rollers since stream of air coming from the bottom and flowing in the direction of arrow 25 is conducted into the region of these rollers and consequently also into the region of the sheets. The air stream absorbs part of the still existing moisture and carries it away with it. To make this drying effective and to also remove any water possibly still adhering to the surfaces of the guide rollers, blow nozzles 26 are provided which ensure that all of the above-mentioned parts are constantly well ventilated.

The final drying section 27 is disposed in a box 28 which is foldably connected by way of a hinge 29 with the machine housing 2. If box 28 is in the working position shown in FIG. 5, the air coming in along arrow 25 flows unimpededly through box 28 as well and carries away the moisture released there. If, for cleaning purposes or in order to remove an accumulation of paper, the box 28 is to be lifted, the air flows unimpededly into the atmosphere. However, as can be seen, the arrangement is such that the normal flow of air is reestablished as soon as the box 28 is pivoted back into the working position.

Box 28 includes, on one hand, a paper material guide path formed of guide rollers 30 and 30' to 33 and 33'. This guide path is occupied by a suitable number of blow nozzles 34 and 35. Box 28 also includes heat radiators 36 and 37 which heat the sheets 17 from the bottom. Such heat radiators may be, for example, infrared radiators which are disposed along the focal lines of parabolic mirrors 38 and 39. The radiators 36 and 37 are heated electrically and controlled electronically so that they will not burn the sheets 17. Additionally, the electronic control takes care that the radiators 36 and 37 are turned off immediately when box 28 is raised. The radiators 36 and 37 are preferably disposed at a separate lower section of box 28 which, in turn, is connected with box 28 by way of a hinge joint 40. In addition to heat radiators 36 and 37, further blow nozzles 41 and 42 are provided in the bottom section of box 28. Finally, the finish dried picture exits at discharge gap 4 and can be removed from the machine.

Figure 6:
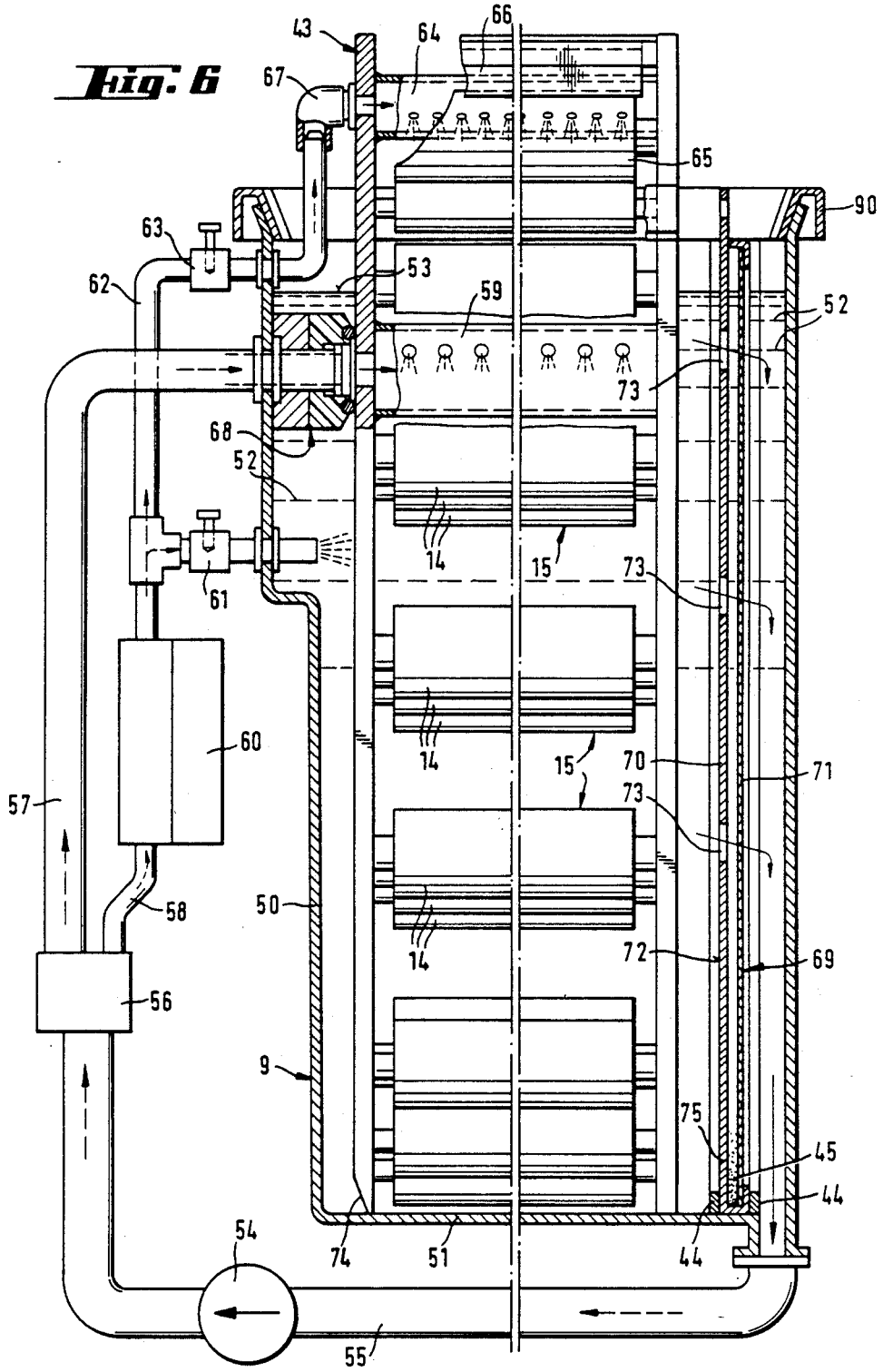
FIG. 6 is a schematic sectional view of a bath fluid circulation system seen along line VI—VI of FIG. 3.

FIG. 6 shows in the form of an exemplary embodiment a schematic representation of a fluid circulation system. Each tank 9 of the developing machine 1 has such an associated system.

FIG. 6 shows at 50 an exterior wall of a tank 9. The bottom of the tank is at 51 and the contents of the tank, for example the bleaching bath, is indicated by hatching 52. During operation of the machine, the bath level is at 53. To circulate and reheat the respective processing bath, it is removed from the tank 9 through a conduit 55 by a pump 54. A bypass 56 which divides the stream of fluid into two branches, shown in FIG. 6 by the two conduits 57 and 58, is inserted into conduit 55. The stream of fluid in conduit 57 is conducted through a nozzle 59 which, when in use, is disposed below the top 53 of the bath. The fluid is discharged directly back into the tank 9. The branch stream in conduit 58 initially passes through a heat exchanger 60 and is then returned to the tank 9, with a controllable valve 61 being disposed in this branch conduit.

The conduit system shown in FIG. 6 has one particularity which generally is used only in connection with the bleaching-fixing bath. This particularity is that the stream of circulating fluid in conduit 58 is again divided so that a further branch stream is taken as symbolized by conduit 62. This branch stream is conducted, preferably again through a valve 63, into a nozzle pipe 64 which moistens a guide roller 65 (also see FIG. 3) over which the photographic paper enters into the bleaching-fixing bath. The purpose of this moistening is to bring the photographic paper, whose coating is still saturated with developer, into contact with the bleaching-fixing bath as early as possible to that the effect of the developer is stopped as quickly as possible.

To prevent any of the bleaching-fixing bath from reaching the developer bath by way of guide roller 65, the latter is equipped with a squeegee 66 which continuously cleans the roller (also see FIG. 3).

FIG. 6 also shows that the various conduits (57, 62) are connected with the respective tank wall 50 or nozzle pipe 64, etc., by way of press-on connectors 68 or plug-in connectors 67. If necessary, these connectors are easily released so that disassembly of the parts for cleaning takes up only little time.

Finally, FIG. 6 shows that tank 9 includes a flat filter 69 (also see FIG. 8) which is disposed in guides 44 in the vicinity of the tank wall and can be pulled out toward the top. The flat filter 69 is composed of a U-shaped holder 70 whose open side is covered with filter fabric 71 and which has openings 73 in its rear side 72 for the passage of the liquid to be filtered. Before liquid 52 is removed from tank 9 by pump 54, it must pass through openings 73 and the filter fabric 71.

FIG. 6 also shows that the rack 43 for guide rollers 65 etc. has a slope 74 at the bottom. This slope serves to press back press-in connector 68, which snaps forward when the rack is absent.

Figure 8:
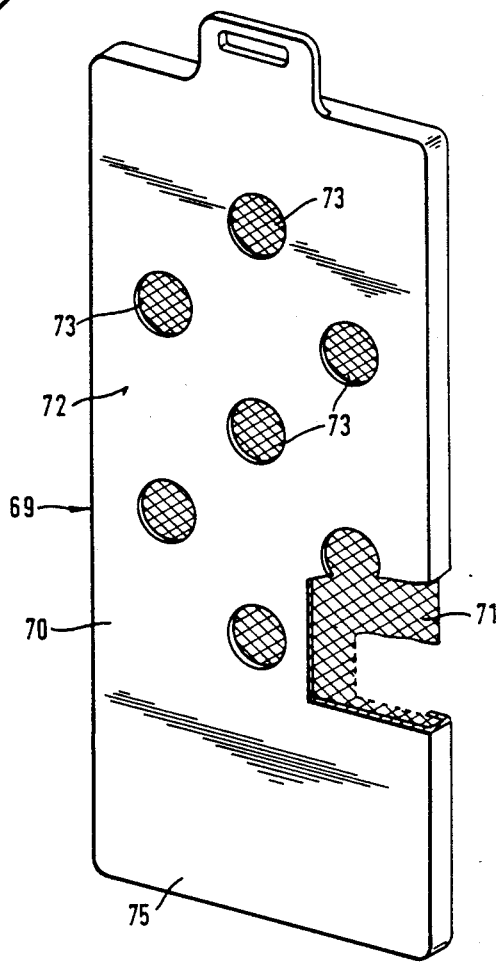
FIG. 8 is a perspective view of a planar filter.

FIG. 8 shows that the openings 73 in holder 70 of the flat filter 69 are disposed only in its upper and middle sections, but not in its lower section 75. In this way, a pocket 45 (see FIG. 6) is formed in this lower section between the rear side 72 of the holder 70 and the filter fabric 71 to permit solids to settle.

Figure 7:
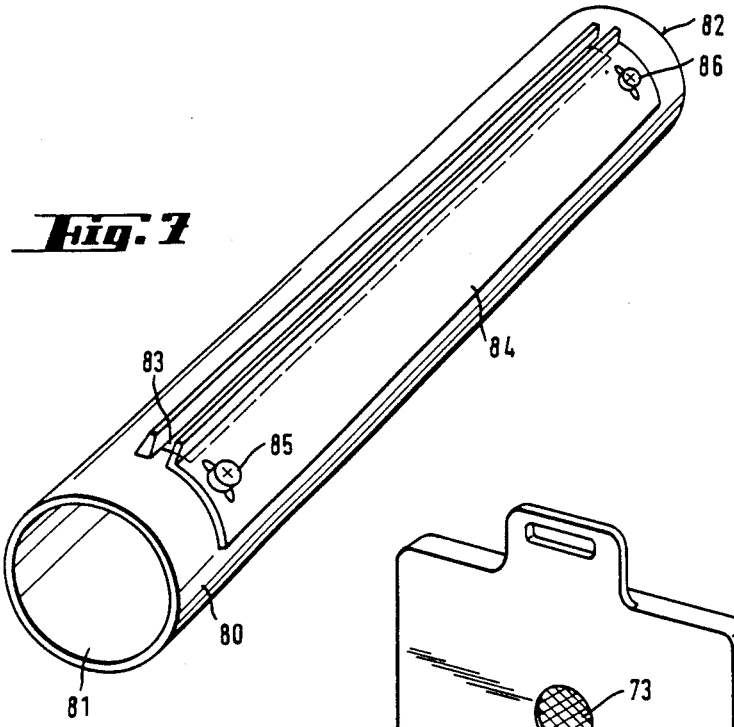
FIG. 7 is a perspective view of an adjustable blow nozzle.

As has been already mentioned, it is of importance for uniform drying of the sheets 17 of photographic paper that the stream of air which supports this drying be uniform over the entire width of the picture. To accomplish this, the use of blow nozzles (e.g., 26, 34, 35, 41, and 42) with adjustable slits is recommended. One embodiment of such a blow nozzle is shown in FIG. 7. The blow nozzle is composed of a nozzle pipe 80 which is open at the front end 81 for connection of the air supply pipe (not shown) and closed at the rear 82 end. The air exit gap 83 which is partially covered by an adjustable cover sheet 84 is disposed on the outer surface of the pipe 80. Cover sheet 84 is adjustable by means of two screws 85 and 86, which are received through slots.

Figure 9:
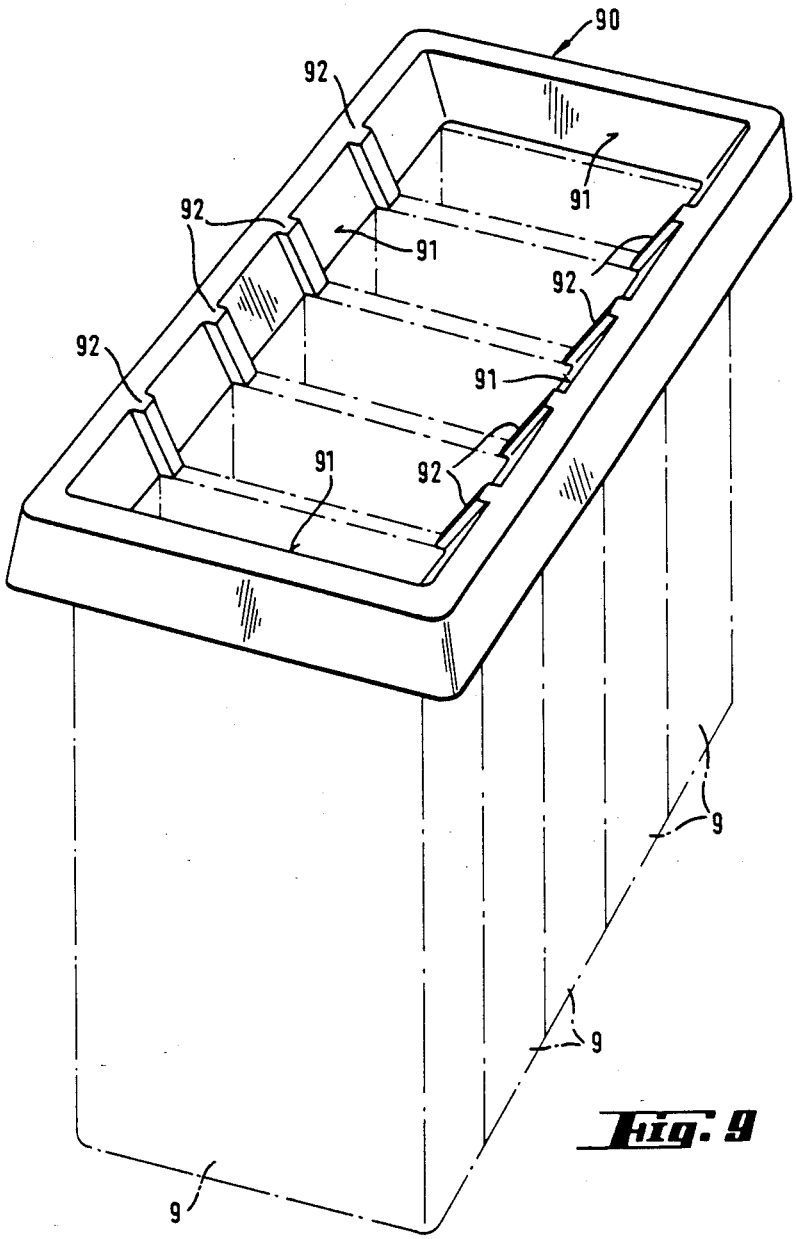
FIG. 9 is a perspective view of a covering frame.

It is important for convenient cleaning of the machine 1 that the guide racks 43 can be removed from tanks 9 easily and without problems. It is of course unavoidable that bath fluid drops from the rollers, guide elements, etc. when the guide racks 43 are removed. To prevent this dropping fluid from contaminating the fluid in the adjacent tanks 9, the entire group of tanks 9 is covered in the region of its upper edges by a frame 90 (see FIGS. 4, 6, and 9). Frame 90 is provided with inwardly oriented drip surfaces 91 which collect fluid dropping down and return it to the tanks 9. In the regions where they border the tanks 9, the drip surfaces 91 are equipped with rib-shaped raised portions 92 which prevent the fluid from passing over the drip surfaces.

It will be understood that the above description of the present invention is susceptible to various modifications, changes, and adaptations, and the same are intended to be comprehended within the meaning and rang of equivalents of the appended claims. In particular, while the foregoing description has explained the operation of photographic developing machine 1 by referring to sheets of photographic paper as an example of the photographic material which is developed, it will be apparent that machine 1 could readily be adapted to development of other photographic materials. For example, photographic paper from continuous a roll could be exposed before it is introduced into machine 1, with individual pictures being cut after development by machine 1. Film for use in producing negatives or positive transparencies could also be developed.

What I claim is:

1. A photographic developing machine for developing photographic material, comprising:

a plurality of tanks to accommodate photographic processing fluids, the tanks being arranged one behind another in a row from an initial tank to a final tank, each tank having an exchangeable rack equipped with planar guide elements and transporting rollers for the photographic material;

a plurality of fluid circulating systems, each fluid circulating system cooperating with a respective tank and including an exchangeable filter, a conduit having a plurality of branches, and a heating member in one of the branches;

a covering frame disposed above the row of tanks, the covering frame having inwardly oriented drip faces;

first means for feeding the photographic material to the initial tank in the row, the first means including at least one pair of feed rollers and a free-wheeling drive unit; and second means for guiding the photographic material from the final tank in the row, the second means including a drying box and means for moving the photographic material through the drying box along a drying path, the drying box being disposed above the tanks and being pivotably mounted for movement between a lowered position and a raised position.

2. The developing machine of claim 1, further comprising a conveying chute, a blower connected to the conveying chute, and sealing elements to airtightly connect the conveying chute to the drying box when the drying box is in its lowered position, and wherein the second means further includes a plurality of guide rollers disposed in the conveying chute to guide the photographic material from the final tank to the drying box, the guide rollers being arranged in an arc to reverse the direction of the photographic material as the photographic material moves from the final tank to the drying box.

3. The developing machine of claim 1, further comprising a conveying chute, and wherein the second means guides the photographic material from the final tank to the drying box through a portion of the conveying chute, and wherein the drying box has a top side which is pivotably connected to the conveying chute.

4. The developing machine of claim 1, wherein the drying box comprises a top portion, a bottom portion having means therein for radiating heat, and a hinge joint connecting the top portion of the drying box to the bottom portion of the drying box

5. The developing mechanism of claim 4, further comprising a conveying chute, the second means guiding the photographic material from the final tank to the drying box through a portion of the conveying chute, and nozzle pipes in the conveying chute and the top and bottom portions of the drying box, each nozzle pipe having a longitudinal axis and an elongated air discharge gap parallel to the longitudinal axis, the air discharge gap being adjustable.

6. The developing machine of claim 5, wherein the means for radiating heat comprises parabolic mirrors having focal lines, and infrared radiators disposed at the focal lines of the parabolic mirrors.

7. The developing machine of claim 1 wherein, for each fluid circulating system, the respective conduit includes first and second branches, wherein the heating member is a heat exchanger in the second branch, and wherein the first branch returns processing fluid directly to the tank while the second branch returns processing fluid to the tank through the heat exchanger.

8. The developing machine of claim 7 wherein each fluid circulating system further comprises a nozzle member in the respective tank at a position below the level of the processing fluid when the developing machine is in operation, the nozzle member being connected to the first branch of the conduit and returning processing fluid received from the first branch directly into the tank.

9. The developing machine of claim 7, wherein one of the tanks is a bleaching tank and the processing fluid accommodated therein is a bleaching fluid, wherein the conduit of the circulating system that cooperates with the bleaching tank further includes a third branch having an adjustable valve therein, and a nozzle pipe which is disposed in the bleaching tank and which receives bleaching fluid from the third branch of the conduit, and wherein one of the transporting rollers for the bleaching tank is a feed roller which conducts the photographic material into the bleaching fluid, the feed roller being wetted by bleaching fluid from the nozzle pipe during operation of the developing machine.

10. The developing machine of claim 9, wherein one of the tanks is a developing tank, the developing tank preceding the bleaching tank in the row of tanks and the feed roller in the bleaching tank having a side which is oriented toward the developing tank, and further comprising squeegee means associated with the feed roller for keeping the feed roller free of bleaching fluid on the side oriented toward the developing tank.

11. The developing machine of claim 7 wherein each fluid circulating system further includes plug-in connectors to connect the branches of the respective conduit to the respective tank.

12. The developing machine of claim 1, wherein each tank has a top end, a wall, and an opening to the conduit of the respective fluid circulating system, wherein the exchangeable filter of the respective fluid circulating system is a flat filter, and wherein the respective fluid circulating system further includes guide means for receiving the flat filter adjacent the wall and the opening of the respective tank and for permitting the flat filter to be pulled out toward the top end of the respective tank

13. The developing machine of claim 12, wherein the flat filter comprise a U-shaped holder having an open side and a rear side with apertures therein, and filter fabric covering the open side of the holder.

14. The developing machine of claim 13, wherein the holder has a bottom end which is closed so as to form a pocket.

15. The developing machine of claim 1, wherein the tanks have upper edges, wherein the covering frame surrounds the row of tanks in the region of their upper edges, and wherein the covering frame includes rib-shaped raised portions disposed on the drip surfaces between adjacent tanks.

16. The developing machine of claim 1, wherein each tank has a vertical axis, and wherein the transporting rollers for each tank are arranged in a plurality of superposed planes which are disposed at predetermined angle to the vertical axis of the respective tank, the predetermined angle to the vertical axis of the respective tank, the predetermined angle ranging from about 70° to about 85°, and wherein the transporting rollers in each superposed plane include at least two mutually offset rollers which are disposed so as to provide a transporting gap.

17. The developing machine of claim 16, wherein the predetermined angle is about 80°.

* * * * *